US012404084B2

(12) United States Patent
Al-Housseiny

(10) Patent No.: US 12,404,084 B2
(45) Date of Patent: Sep. 2, 2025

(54) CONTAINER WITH A MOVABLE SEPARATION PANEL

(71) Applicant: Talal Al-Housseiny, Princeton, NJ (US)

(72) Inventor: Talal Al-Housseiny, Princeton, NJ (US)

( * ) Notice: Subject to any disclaimer, the term of this patent is extended or adjusted under 35 U.S.C. 154(b) by 177 days.

(21) Appl. No.: 18/201,475

(22) Filed: May 24, 2023

(65) Prior Publication Data

US 2024/0300713 A1 Sep. 12, 2024

Related U.S. Application Data

(60) Provisional application No. 63/451,345, filed on Mar. 10, 2023.

(51) Int. Cl.
*B65D 5/46* (2006.01)
*B65D 71/30* (2006.01)

(52) U.S. Cl.
CPC ..... *B65D 71/30* (2013.01); *B65D 5/46072* (2013.01); *B65D 2571/00512* (2013.01); *B65D 2571/0066* (2013.01); *B65D 2571/00716* (2013.01)

(58) Field of Classification Search
CPC ..... B65D 5/46093–46176; B65D 5/46; B65D 5/46088; B65D 71/30; B65D 2571/00481; B65D 2571/00487; B65D 2571/00512; B65D 2571/0066; B65D 2571/00716
USPC ..... 229/117.09, 117.12, 117.14, 120.14, 229/120.18, 120.26; 206/427, 170, 141, 206/180
See application file for complete search history.

(56) References Cited

U.S. PATENT DOCUMENTS 2,785,846 A * 3/1957 Weiner ..... B65D 5/46096 229/117.22
3,158,286 A * 11/1964 Phillips, Jr. ..... B65D 71/0022 229/117
3,283,949 A * 11/1966 Wysocki ..... B65D 71/0022 206/187

(Continued)

FOREIGN PATENT DOCUMENTS

DE 1806349 A1 * 6/1970
GB 2242675 A * 10/1991 ..... B65D 71/30

(Continued)

*Primary Examiner* — Nathan J Newhouse
*Assistant Examiner* — Phillip D Schmidt
(74) *Attorney, Agent, or Firm* — MEAGHER EMANUEL LAKS GOLDBERG & LIAO, LLP

(57) ABSTRACT

A container movable between a flat configuration and a box configuration is disclosed. The container comprises a first side panel hingedly coupled to a first side portion, a second side panel hingedly coupled to a second side portion, a separation panel, and a bottom panel. The separation panel is hingedly coupled to the first side portion and to the second side portion. When the container is in the box configuration, the bottom panel and the separation panel face each other, and the first side panel and the second side panel face each other. The container is further movable between the box configuration and a formed configuration. When the container is in the formed configuration, the first side portion and the first side panel face each other, the second side portion and the second side panel face each other, and the separation panel and the bottom panel are substantially orthogonal.

15 Claims, 13 Drawing Sheets

(56) References Cited

U.S. PATENT DOCUMENTS

| | | | | | |
|---|---|---|---|---|---|
| 3,570,706 | A * | 3/1971 | Harrelson | B65D 71/0022 | 206/187 |
| 3,780,906 | A | 12/1973 | Katzenmeyer | | |
| 4,256,223 | A * | 3/1981 | Pawlowski | B65D 5/4204 | 206/192 |
| 4,782,943 | A * | 11/1988 | Blackman | B65D 71/0022 | 206/175 |
| 5,775,574 | A * | 7/1998 | Whitnell | B65D 5/46184 | 206/175 |
| 5,816,411 | A * | 10/1998 | Smith | B65D 5/46096 | 206/769 |
| 7,383,949 | B2 | 6/2008 | Cuomo | | |
| 7,438,181 | B2 | 10/2008 | Cuomo | | |
| 8,297,437 | B2 | 10/2012 | Smalley | | |
| 8,622,207 | B2 | 1/2014 | Smalley | | |
| 9,415,914 | B2 | 8/2016 | Holley, Jr. | | |
| 2006/0091190 | A1 * | 5/2006 | Nikolai | B65D 5/067 | 229/117.22 |
| 2013/0202225 | A1 | 8/2013 | Metcalfe | | |
| 2021/0024247 | A1 * | 1/2021 | Sollie | B65D 5/4266 | |
| 2021/0292042 | A1 * | 9/2021 | Sollie | B65D 5/4266 | |

FOREIGN PATENT DOCUMENTS

| | | | | |
|---|---|---|---|---|
| JP | 6077588 | B2 | 2/2017 | |
| KR | 20140066046 | A * | 5/2014 | |
| WO | WO-2006050207 | A1 * | 5/2006 | B65D 5/064 |

* cited by examiner

300a

300b

300c

300d

400c

400d

400e

400f

CONTAINER WITH A MOVABLE SEPARATION PANEL

CROSS-REFERENCE TO RELATED APPLICATIONS

The present application claims priority to U.S. 63/451,345, filed Mar. 10, 2023, the contents of which are incorporated by reference herein in its entirety.

TECHNICAL FIELD

Embodiments are in the field of containers. More particularly, embodiments disclosed herein relate to containers which, inter alia, foster a container with a movable separation panel. The container can be rapidly and easily formed. The container may be used to carry cups and beverages. The container provides convenience while reducing material and manufacturing costs.

BACKGROUND

There are several challenges that are associated with packaging food, cups, beverages, consumer products, etc. For example, containers may be required to be held for a variety of purposes such as carrying, lifting, pouring, serving, using, delivering, catering, storing, moving, transporting, etc. In addition, these containers may be required to be formed quickly and conveniently.

To address the previous challenges, a number of packaging solutions have been proposed. These packaging solutions (e.g., extended handles, cup carriers, large folding trays, etc.) use significantly more material than required by typical containers. As a result, cost effectiveness may be compromised. In addition, these packaging solutions may not provide a convenient box forming experience.

Thus, it is desirable to provide a container that is able to overcome the above disadvantages.

Advantages of the present disclosure will become more fully apparent from the detailed description.

BRIEF SUMMARY

Embodiments of the present disclosure are drawn to a container, where the container or a blank used to make the container comprises two side panels, two side portions, a separation panel, and a bottom panel.

A first aspect of the present disclosure is drawn to embodiments directed to a container and to blanks used for making the container. The container is movable between a flat configuration and a box configuration. The container comprises a first side panel hingedly coupled to a first side portion, a second side panel hingedly coupled to a second side portion, a separation panel, and a bottom panel. The separation panel is hingedly coupled to the first side portion. The separation panel is hingedly coupled to the second side portion. The separation panel comprises a handle. The bottom panel and the separation panel face each other when the container is in the box configuration. The first side panel and the second side panel face each other when the container is in the box configuration. The container is further movable between the box configuration and a formed configuration. The first side portion is configured to fold towards the first side panel. The second side portion is configured to fold towards the second side panel. The first side portion and the first side panel face each other when the container is in the formed configuration. The second side portion and the second side panel face each other when the container is in the formed configuration. The separation panel and the bottom panel are substantially orthogonal with respect to each other when the container is in the formed configuration. The container is configured to be held via the handle when the container is in the formed configuration.

A second aspect of the present disclosure is drawn to embodiments directed to a container and to blanks used for making the container. The container is movable between a flat configuration and a box configuration. The container comprises a first side panel hingedly coupled to a first side portion, a second side panel hingedly coupled to a second side portion, a separation panel, and a bottom panel. The separation panel is hingedly coupled to the first side portion. The separation panel is hingedly coupled to the second side portion. The bottom panel and the separation panel face each other when the container is in the box configuration. The first side panel and the second side panel face each other when the container is in the box configuration. The container is further movable between the box configuration and a formed configuration. The first side portion is configured to fold towards the first side panel. The second side portion is configured to fold towards the second side panel. The first side portion and the first side panel face each other when the container is in the formed configuration. The second side portion and the second side panel face each other when the container is in the formed configuration. The separation panel and the bottom panel are substantially orthogonal with respect to each other when the container is in the formed configuration.

Additional embodiments and additional features of embodiments for containers or for blanks used for making containers are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION

Figure 1A:
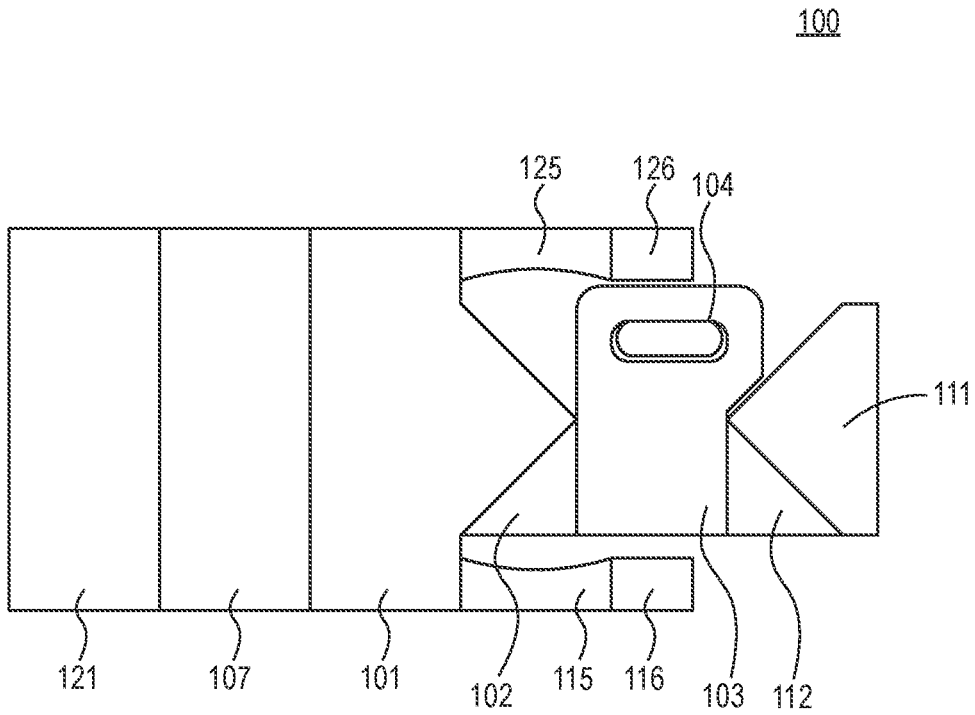
FIG. 1A is a diagram illustrating a plan view of an embodiment of a blank used for making a container. The blank comprises a first side panel hingedly coupled to a first side portion, a second side panel hingedly coupled to a second side portion, a separation panel, and a bottom panel. The separation panel is hingedly coupled to the first side portion. The separation panel is hingedly coupled to the second side portion. The separation panel comprises a handle. The blank also comprises two end flaps and a complementary side panel.

It is to be understood that the figures and descriptions of the present disclosure may have been simplified to illustrate elements that are relevant for a clear understanding of the present disclosure, while eliminating, for purposes of clarity, other elements found in a typical container or typical method of using a container. Those of ordinary skill in the art will recognize that other elements may be desirable and/or required in order to implement the embodiments disclosed herein. However, because such elements are well known in the art, and because they do not facilitate a better understanding of the present disclosure, a discussion of such elements is not provided herein. It is also to be understood that the drawings included herewith only provide diagrammatic representations of the presently preferred structures of the present disclosure and that structures falling within the scope of the present disclosure may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

For purposes of this disclosure, the expression "A is hingedly coupled to B" refers to an element A being movably coupled to an element B via a hinge. A hinge may comprise a perforation, a crease, a score, a bend, a section with less thickness than surrounding material, a section with less density than surrounding material, and a combination thereof. The coupling of element A and element B via a hinge may require folding, joining, and/or attaching elements of a blank (e.g. by using a glue tab, a glue flap, an extended tab, an extended flap, etc.)

For purposes of this disclosure, the expression "A is configured to fold towards B" refers to at least a portion of element A being configured to fold towards at least a portion of element B via a hinge.

For purposes of this disclosure, the "usable space of the container" refers to a space that is configured to contain content to be carried and/or to be held in the container when the container is in a formed configuration.

For purposes of this disclosure, the expression "A and B are substantially orthogonal with respect to each other" refers to the angle defined by element A and element B being within a reasonable range from a right angle (e.g., 90°±30°).

Embodiments are directed to a container. Embodiments are also directed to a blank used for making a container. The container may be used for packaging various products (e.g., cups, beverages, bottles, consumer products, etc.), and for shipping (e.g., moving, carrying, deliveries, catering, etc.), or other suitable uses. The uses of the container are abundant. The spectrum of users may include manufacturers, restaurants, retailers, stores, distributors (e.g., fulfillment centers, warehouses, storage facilities, etc.), end-customers, and consumers. For example, the container may be used to carry cups, beverages and bottles for take-out, catering, food delivery, food transportation, etc.

The composition of the containers may vary. Portions or all of the container may comprise a suitable flexible material that allows for folding, collapsing, and moving such as cardboard, paperboard, paper, corrugated carton, plastic, corrugated plastic, polymers, metal, or combinations thereof. In addition, the container may comprise a plurality of different suitable materials. The material of any portion of the container may be chosen for reusability of the container, or, alternatively, the material may be chosen based on a disposable (i.e., a one-time or limited use) variation.

The size, dimensions, thickness, shape, and weight of the container or portions of the container may vary. Portions or all of the container may be configured based on the desired overall features of the container, content to be contained in the container, and/or content to be carried in the container. Hence, the size, dimensions, thickness, shape and weight of portions or all of the container may vary. Moreover, the position, the length and the orientation of the various hinges may be configured based on the desired overall features of the container.

The manufacturing of the container may vary. Desired objectives for the manufacturing processes may include reducing material costs, reducing manufacturing costs, reducing material waste, reducing manufacturing complexity, reducing shipping costs, or a combination thereof. The container may be made from a single sheet of material or may be assembled by coupling (e.g., connecting, attaching, joining, etc.) various portions of a plurality of independent sheets of material. Furthermore, portions or all of the container may comprise more than one layer of material. For example, multiple layers of material may be attached or glued to each other.

The manufacturing of the blank may vary. Desired objectives for the manufacturing processes may include reducing material costs, reducing manufacturing costs, reducing material waste, reducing manufacturing complexity, reducing shipping costs, or a combination thereof. The blank may be made from a single sheet of material or may be assembled by coupling (e.g., connecting, attaching, joining, etc.) various portions of a plurality of independent sheets of material.

FIG. 1A is a diagram illustrating a plan view of an embodiment of a blank 100 used for making a container. The blank comprises a first side panel 101 hingedly coupled to a first side portion 102, a second side panel 111 hingedly coupled to a second side portion 112, a separation panel 103, and a bottom panel 107. The separation panel 103 is hingedly coupled to the first side portion 102. The separation panel 103 is hingedly coupled to the second side portion 112. The separation panel 103 comprises a handle 104. The blank 100 also comprises two end flaps 115, 125 and a complementary side panel 121.

Figure 1B:
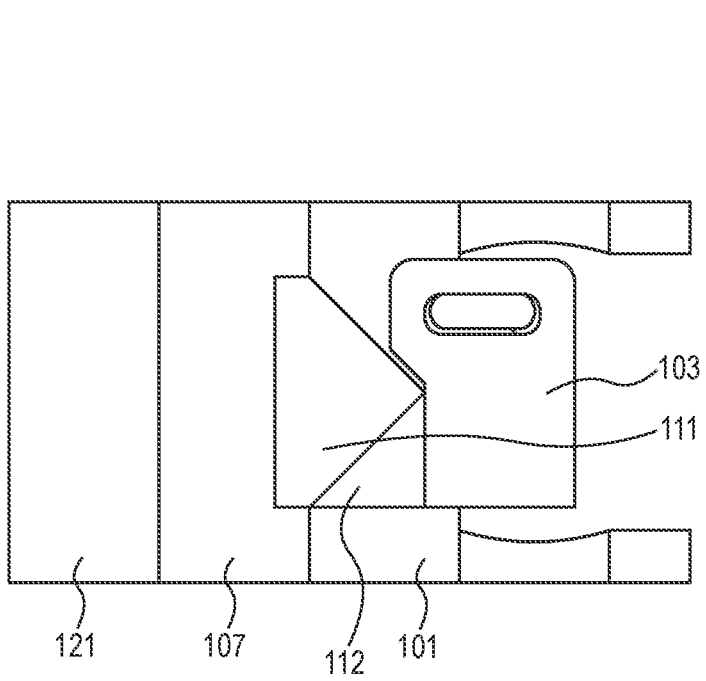
FIG. 1B is a diagram illustrating the blank shown in FIG. 1A, wherein the separation panel is folded towards the first side portion.

FIG. 1B is a diagram illustrating the blank 100 shown in FIG. 1A. The separation panel 103 is folded towards the first side portion 102.

Figure 1C:
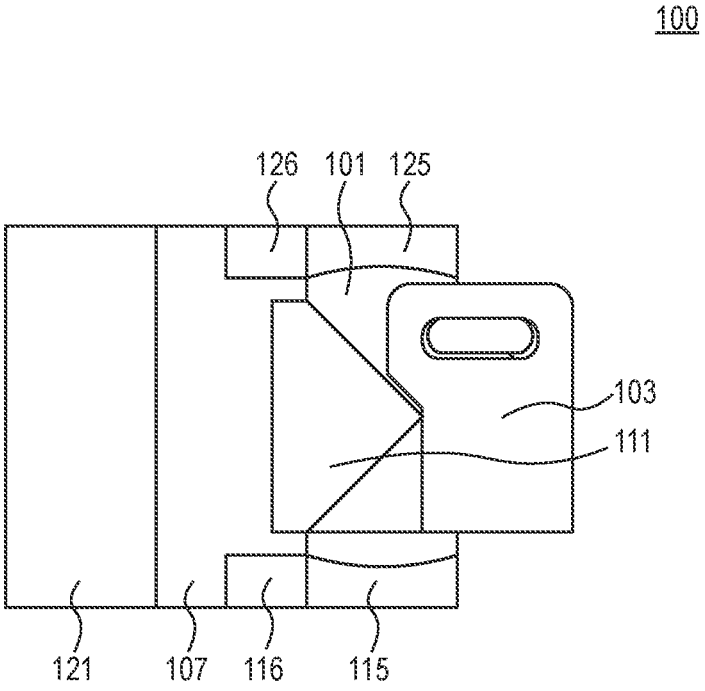
FIG. 1C is a diagram illustrating the blank shown in FIG. 1A. In addition to the folding shown in FIG. 1B, the two end flaps are folded towards the first side panel.

FIG. 1C is a diagram illustrating the blank 100 shown in FIG. 1A. In addition to the folding shown in FIG. 1B, the two end flaps 115, 125 are folded towards the first side panel 101.

Figure 1D:
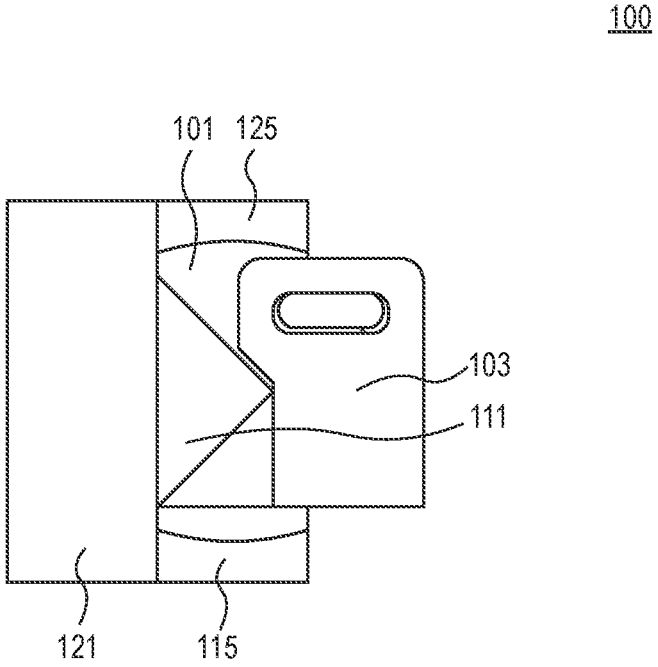
FIG. 1D is a diagram illustrating a top view of a flat configuration of the container made from the blank shown in FIG. 1A. In addition to the folding shown in FIG. 1C, the complementary side panel is folded towards the bottom panel.

FIG. 1D is a diagram illustrating a top view of a flat configuration of the container made from the blank 100 shown in FIG. 1A. In addition to the folding shown in FIG. 1C, the complementary side panel 121 is folded towards the bottom panel 107.

Figure 1E:
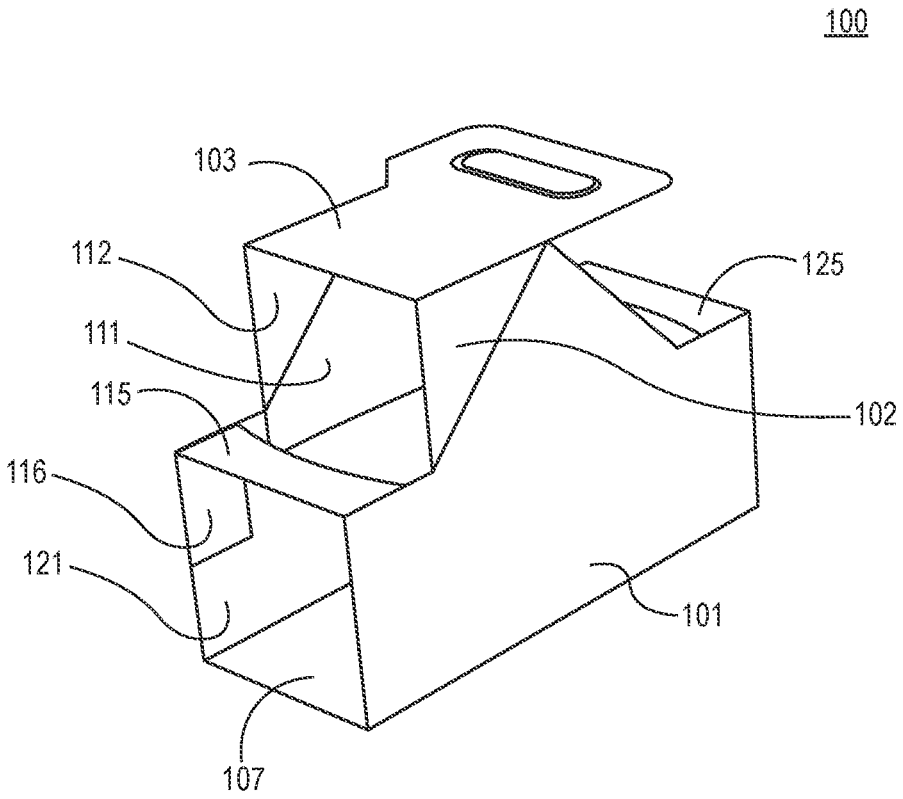
FIG. 1E is a diagram illustrating a perspective view of a box configuration of the container made from the blank shown in FIG. 1A.

FIG. 1E is a diagram illustrating a perspective view of a box configuration of the container made from the blank 100 shown in FIG. 1A.

Figure 1F:
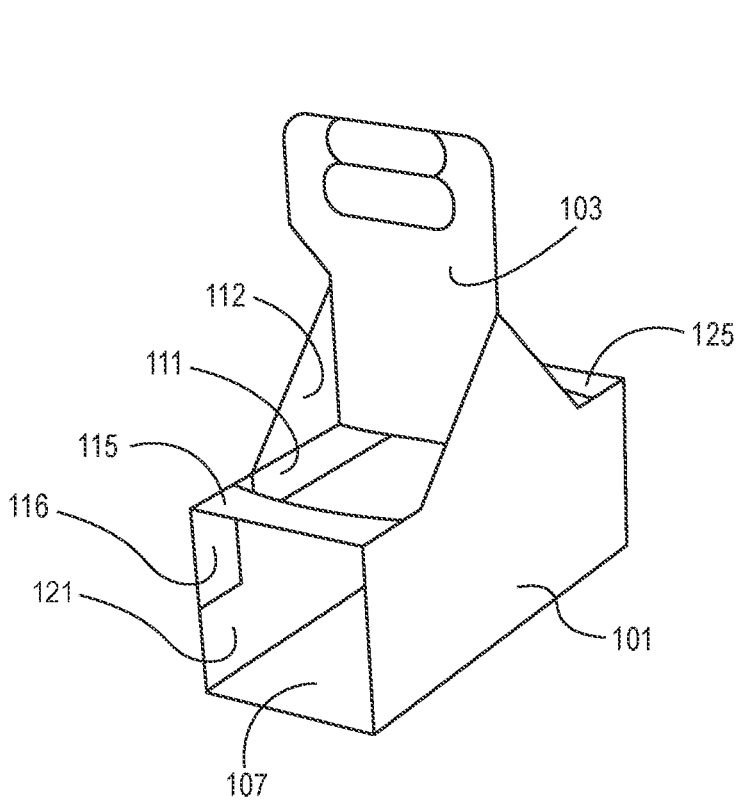
FIG. 1F is a diagram illustrating a perspective view of a formed configuration of the container made from the blank shown in FIG. 1A.

FIG. 1F is a diagram illustrating a perspective view of a formed configuration of the container made from the blank 100 shown in FIG. 1A.

Figure 2A:
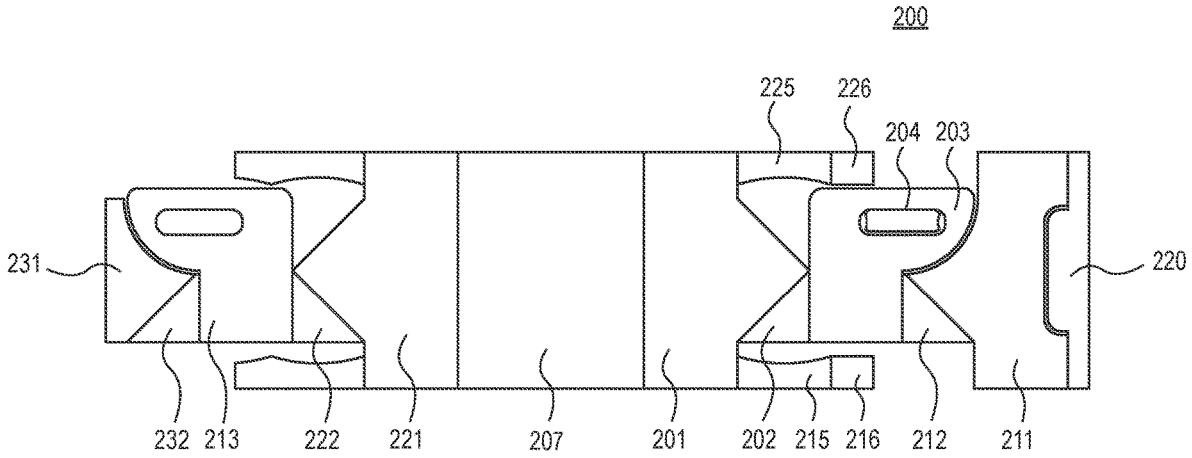
FIG. 2A is a diagram illustrating a plan view of an embodiment of a blank used for making a container. The blank comprises a first side panel hingedly coupled to a first side portion, a second side panel hingedly coupled to a second side portion, a third side panel hingedly coupled to a third side portion, a fourth side panel hingedly coupled to a fourth side portion, a separation panel (also referred to as a first separation panel), a second separation panel, and a bottom panel. The separation panel is hingedly coupled to the first side portion. The separation panel is hingedly coupled to the second side portion. The separation panel comprises a handle. The second separation panel is hingedly coupled to the third side portion. The second separation panel is hingedly coupled to the fourth side portion. The blank also comprises two end flaps.

FIG. 2A is a diagram illustrating a plan view of an embodiment of a blank 200 used for making a container. The blank 200 comprises a first side panel 201 hingedly coupled to a first side portion 202, a second side panel 211 hingedly coupled to a second side portion 212, a third side panel 221 hingedly coupled to a third side portion 222, a fourth side panel 231 hingedly coupled to a fourth side portion 232, a separation panel 203 (also referred to as a first separation panel 203), a second separation panel 213, and a bottom panel 207. The separation panel 203 is hingedly coupled to the first side portion 202. The separation panel 203 is hingedly coupled to the second side portion 212. The separation panel 203 comprises a handle 204. The second separation panel 213 is hingedly coupled to the third side portion 222. The second separation panel 213 is hingedly coupled to the fourth side portion 232. The blank 200 also comprises two end flaps 215, 225.

Figure 2B:
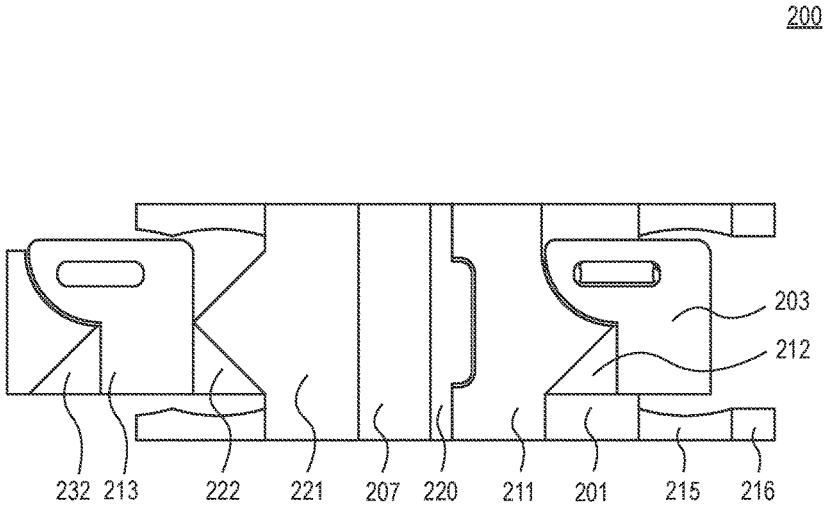
FIG. 2B is a diagram illustrating the blank shown in FIG. 2A, wherein the separation panel is folded towards the first side portion.

FIG. 2B is a diagram illustrating the blank 200 shown in FIG. 2A. The separation panel 203 is folded towards the first side portion 202.

Figure 2C:
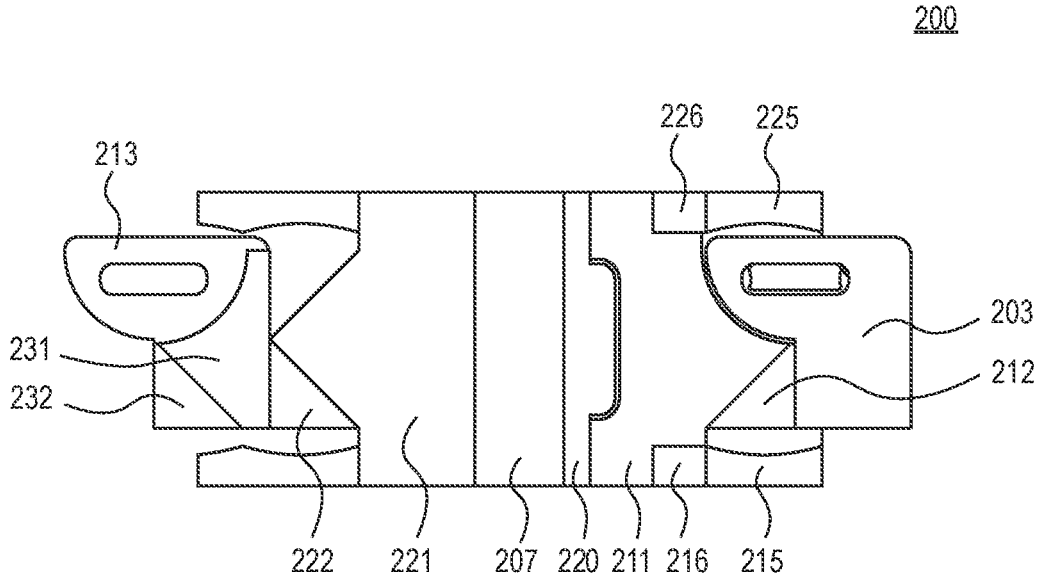
FIG. 2C is a diagram illustrating the blank shown in FIG. 2A. In addition to the folding shown in FIG. 2B, the two end flaps are folded towards the first side panel and the fourth side portion is folded towards the second separation panel.

FIG. 2C is a diagram illustrating the blank 200 shown in FIG. 2A. In addition to the folding shown in FIG. 2B, the two end flaps 215, 225 are folded towards the first side panel 201 and the fourth side portion 232 is folded towards the second separation panel 213.

Figure 2D:
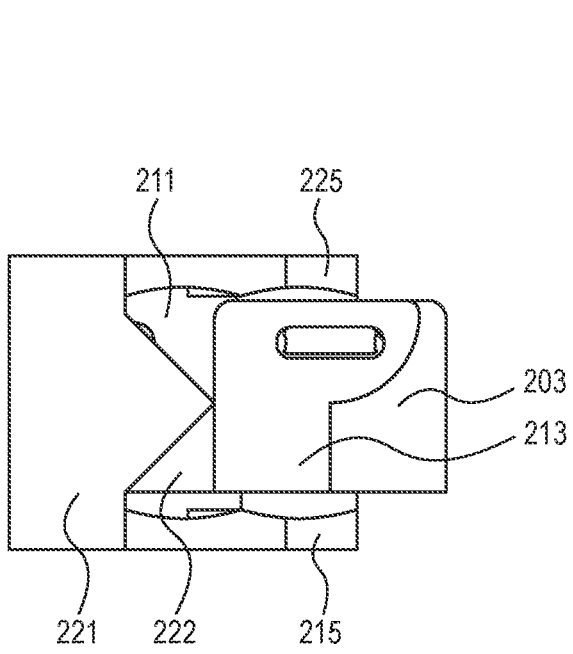
FIG. 2D is a diagram illustrating a top view of a flat configuration of the container made from the blank shown in FIG. 2A. In addition to the folding shown in FIG. 2C, the third side panel is folded towards the bottom panel.

FIG. 2D is a diagram illustrating a top view of a flat configuration of the container made from the blank 200 shown in FIG. 2A. In addition to the folding shown in FIG. 2C, the third side panel 221 is folded towards the bottom panel 207.

Figure 2E:
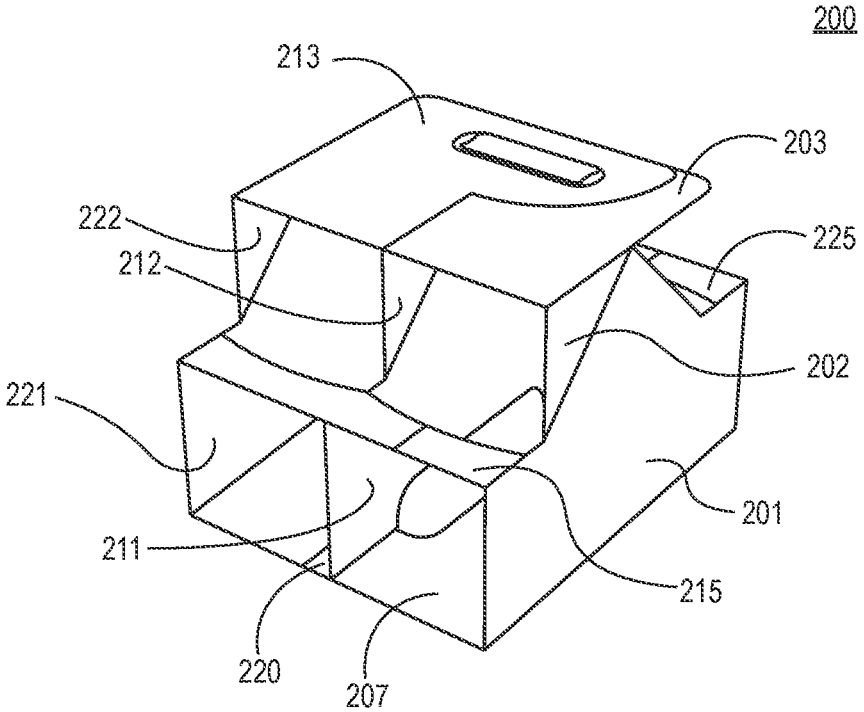
FIG. 2E is a diagram illustrating a perspective view of a box configuration of the container made from the blank shown in FIG. 2A.

FIG. 2E is a diagram illustrating a perspective view of a box configuration of the container made from the blank 200 shown in FIG. 2A.

Figure 2F:
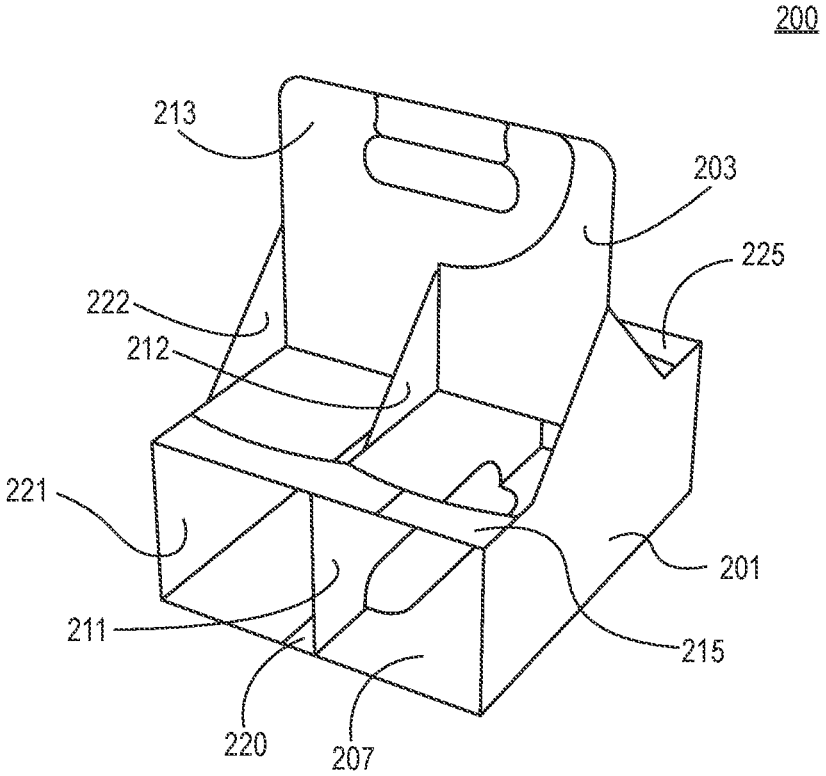
FIG. 2F is a diagram illustrating a perspective view of a formed configuration of the container made from the blank shown in FIG. 2A.

FIG. 2F is a diagram illustrating a perspective view of a formed configuration of the container made from the blank 200 shown in FIG. 2A.

Figure 3A:
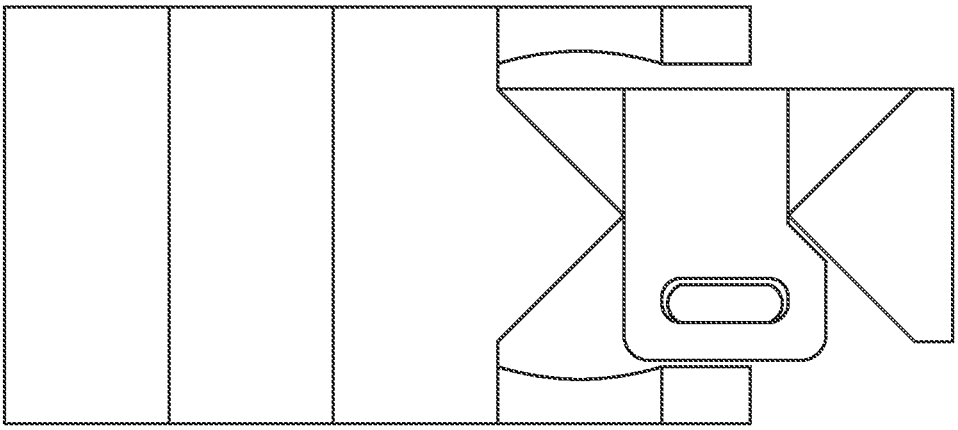
FIGS. 3A-3F, 4A-4F, and 5A-5B are diagrams illustrating plan views of embodiments of blanks used for making containers. The blanks shown in FIGS. 3A-3F and in FIGS. 5A-5B are alternative configurations to the blank shown in FIG. 1A. The blanks shown in FIGS. 4A-4F are alternative configurations to the blank shown in FIG. 2A.
Figure 3B:
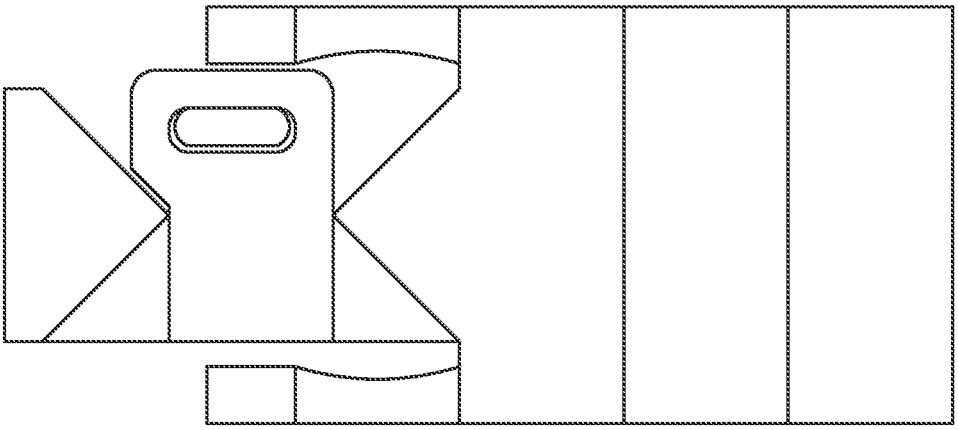
Figure 3C:
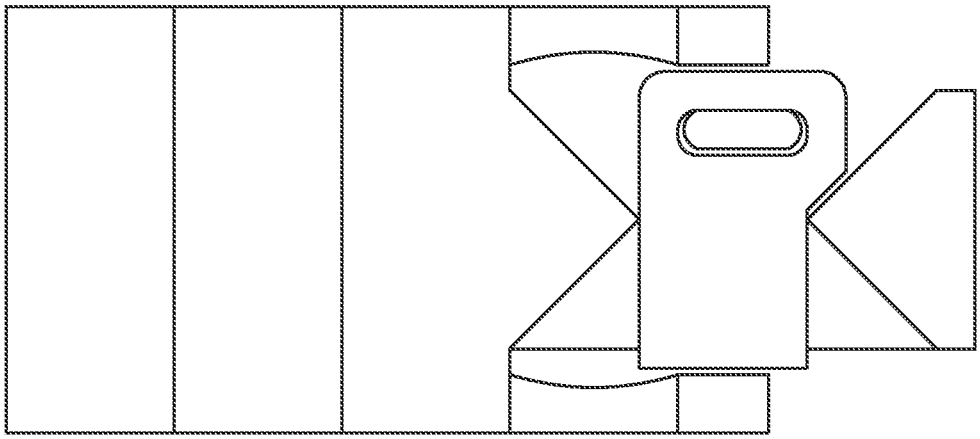
Figure 3D:
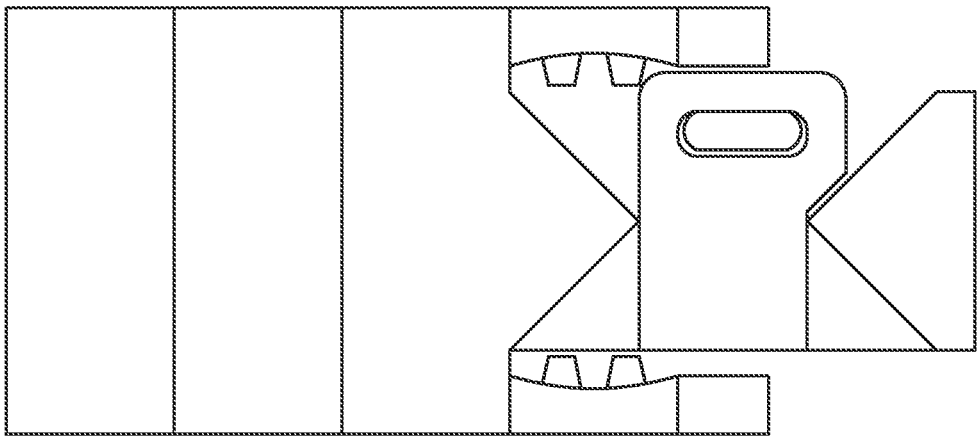
Figure 3E:
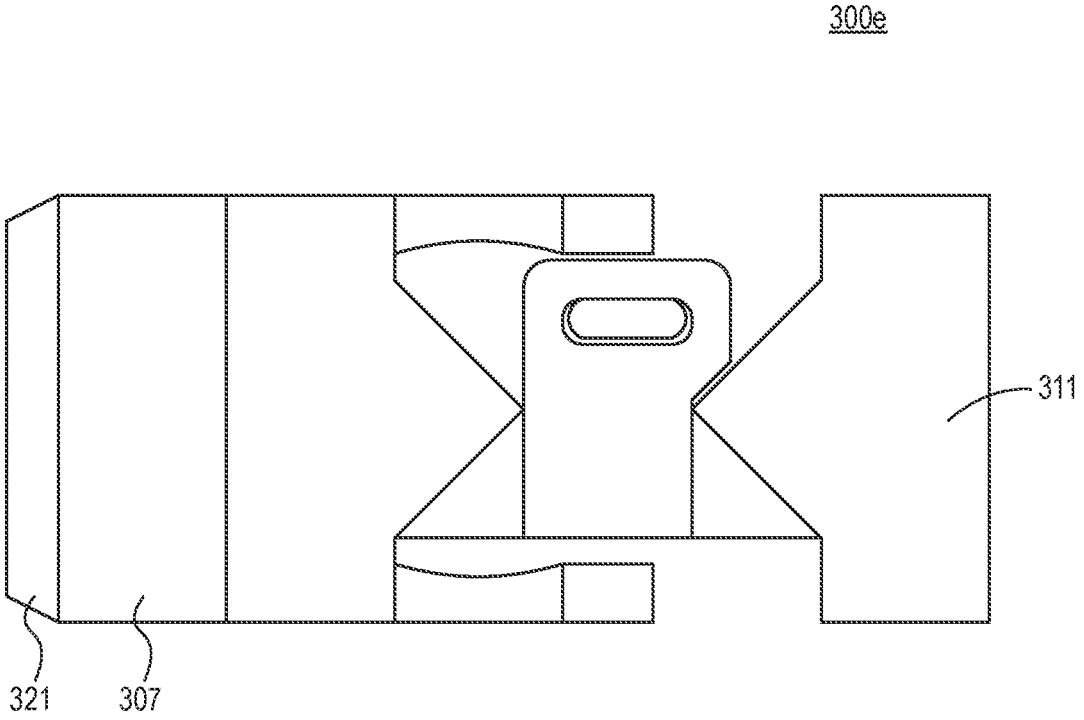
Figure 3F:
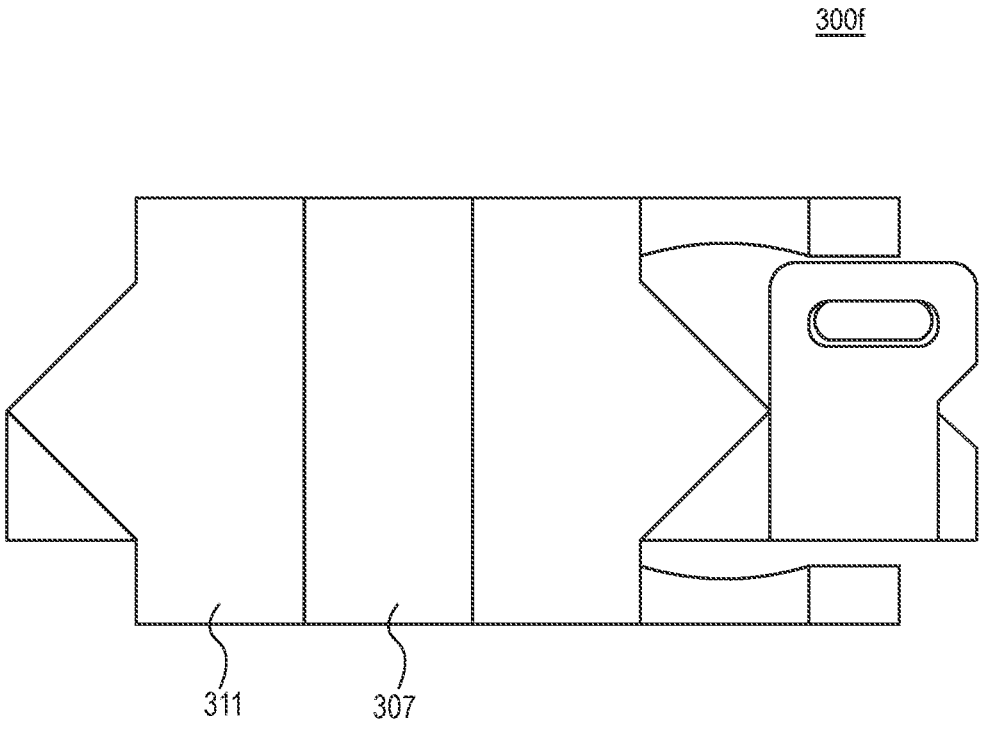
Figure 4A:
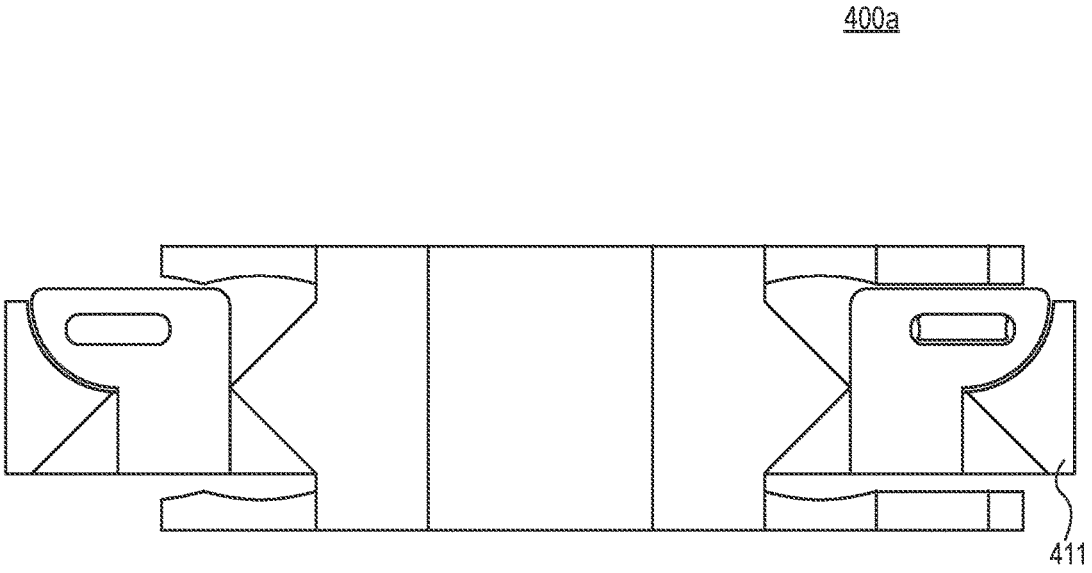
Figure 4B:
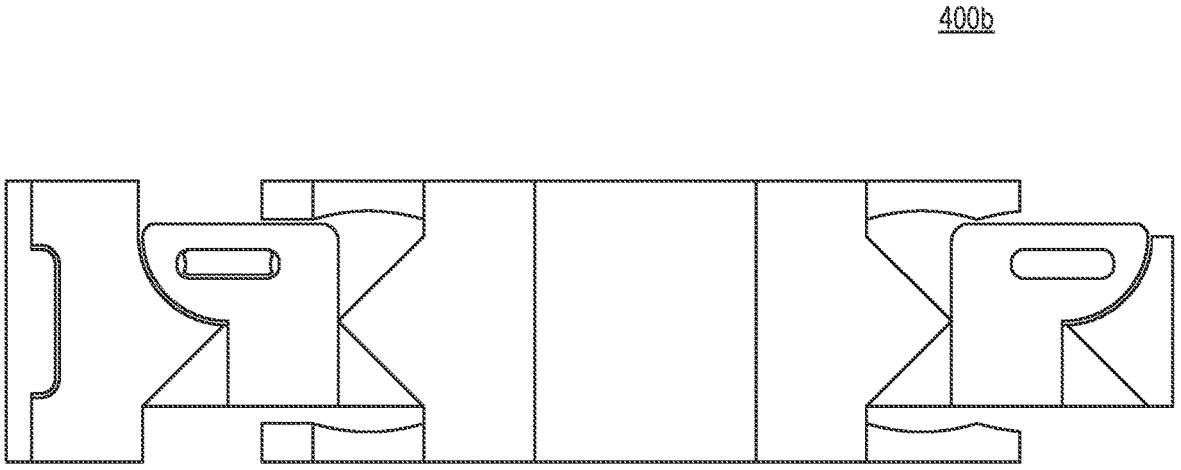
Figure 4C:
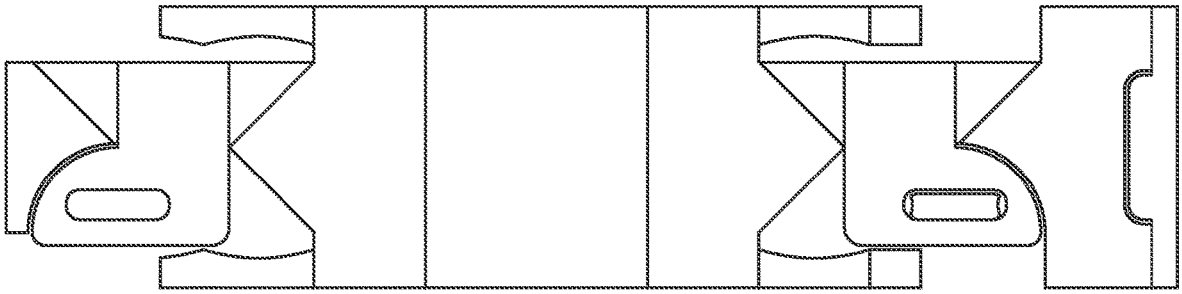
Figure 4D:
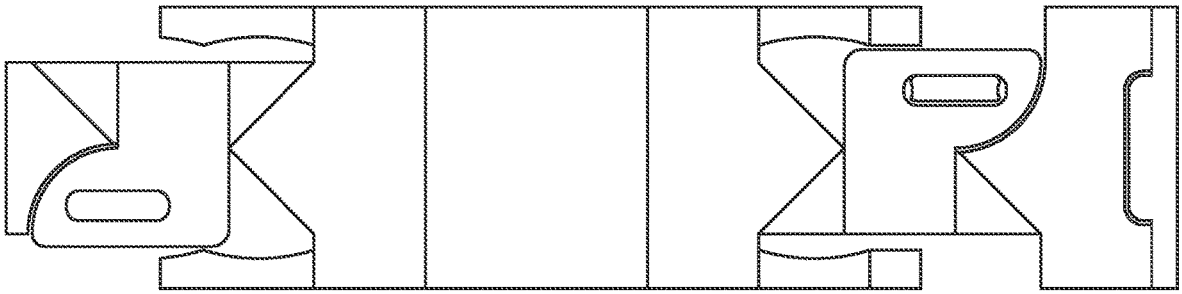
Figure 4E:
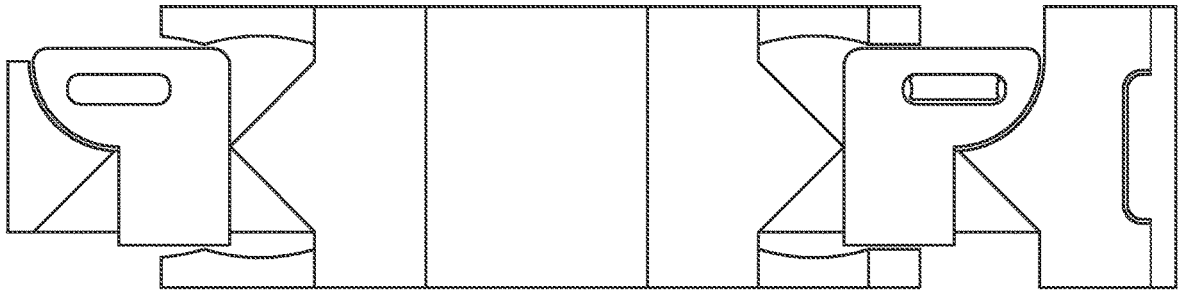
Figure 4F:
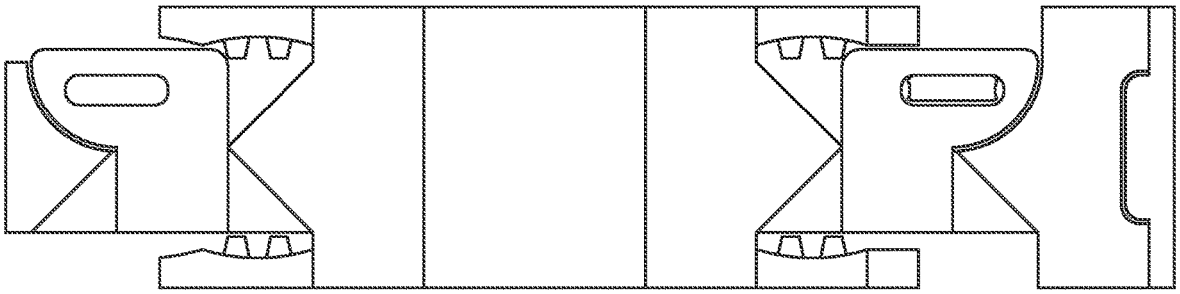
Figure 5A:
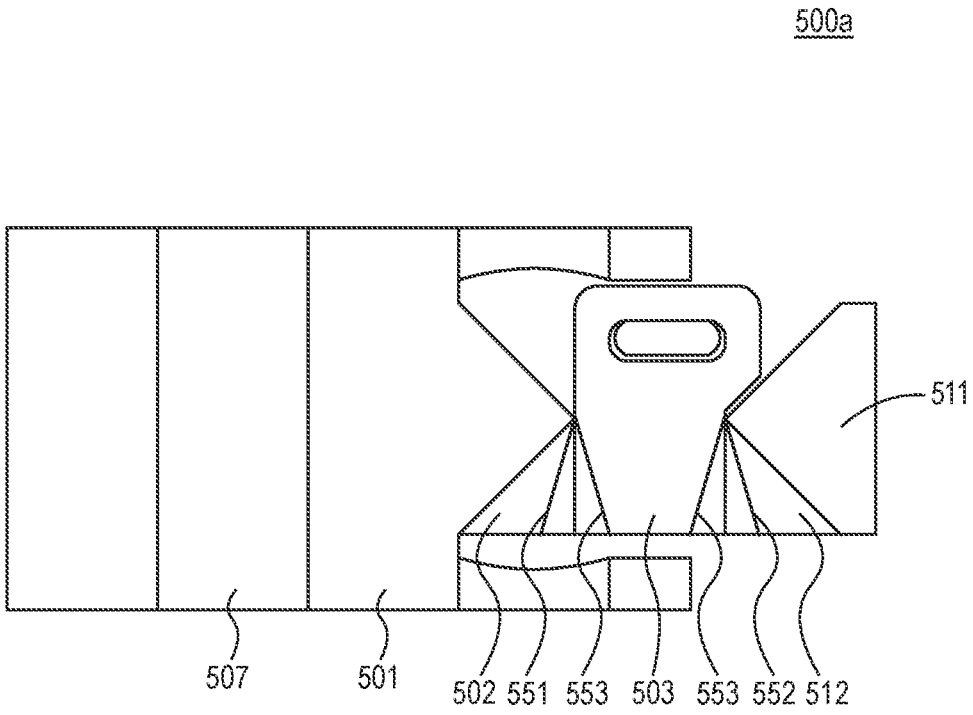
Figure 5B:
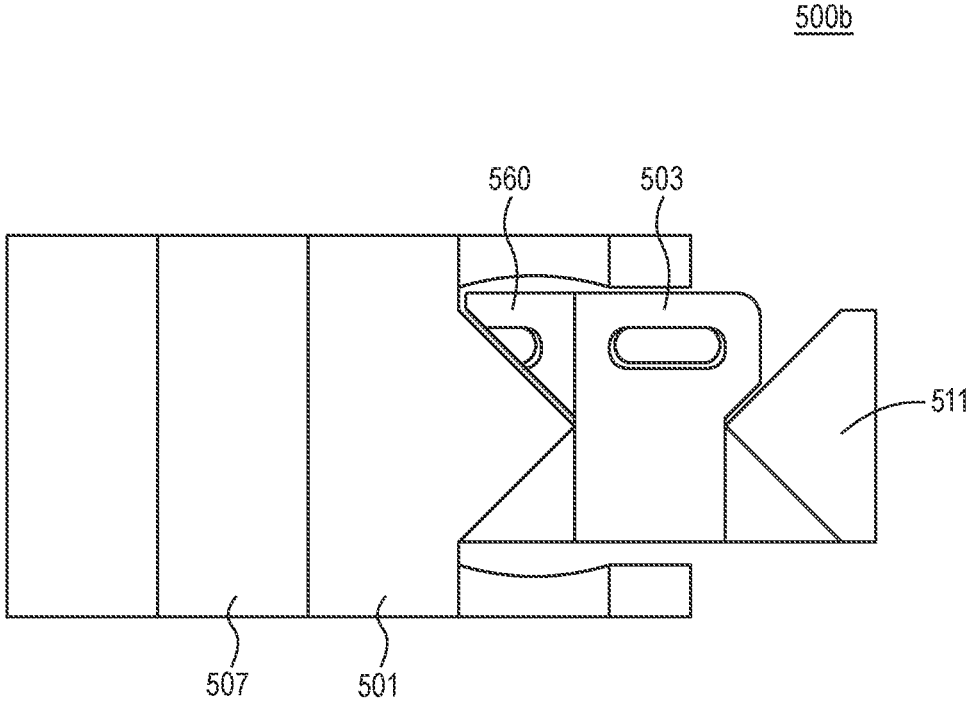

FIGS. 3A-3F, 4A-4F, and 5A-5B are diagrams illustrating plan views of embodiments of blanks 300*a*, 300*b*, 300*c*, 300*d*, 300*e*, 300*f*, 400*a*, 400*b*, 400*c*, 400*d*, 400*e*, 400*f*, 500*a*, 500*b* used for making containers. The blanks 300*a*, 300*b*, 300*c*, 300*d*, 300*e*, 300*f*, 500*a*, 500*b* shown in FIGS. 3A-3F and in FIGS. 5A-5B are alternative configurations to the blank 100 shown in FIG. 1A. For example, the second side panel 311 shown in FIG. 3E is extended in comparison to the second side panel 111 shown in FIG. 1A. The blanks 400*a*, 400*b*, 400*c*, 400*d*, 400*e*, 400*f* shown in FIGS. 4A-4F are alternative configurations to the blank 200 shown in FIG. 2A. For example, the second side panel 411 shown in FIG. 4A is not extended in comparison to the second side panel 211 shown in FIG. 2A.

With reference to FIGS. 1D-IF and 2D-2F, embodiments are directed to a container movable between a flat configuration (e.g., FIGS. 1D and 2D) and a box configuration (e.g., FIGS. 1E and 2E). The container comprises a first side panel 101, 201 hingedly coupled to a first side portion 102, 202, a second side panel 111, 211 hingedly coupled to a second side portion 112, 212, a separation panel 103, 203, and a bottom panel 107, 207. The separation panel 103, 203 is hingedly coupled to the first side portion 102, 202. The separation panel 103, 203 is hingedly coupled to the second side portion 112, 212. The separation panel 103, 203 comprises a handle 104, 204. The bottom panel 107, 207 and the separation panel 103, 203 face each other when the container is in the box configuration (e.g., FIGS. 1E and 2E). The first side panel 101, 201 and the second side panel 111, 211 face each other when the container is in the box configuration (e.g., FIGS. 1E and 2E). The container is further movable between the box configuration (e.g., FIGS. 1E and 2E) and a formed configuration (e.g., FIGS. 1F and 2F). The first side panel 101, 201 and the second side panel 111, 211 face each other when the container is in the formed configuration (e.g., FIGS. 1F and 2F). The first side portion 102, 202 is configured to fold towards the first side panel 101, 201. The second side portion 112, 212 is configured to fold towards the second side panel 111, 211. The first side portion 102, 202 and the first side panel 101, 201 face each other when the container is in the formed configuration (e.g., FIGS. 1F and 2F; the first side portion 102, 202 is not visible). The second side portion 112, 212 and the second side panel 111, 211 face each other when the container is in the formed configuration (e.g., FIGS. 1F and 2F). The separation panel 103, 203 and the bottom panel 107, 207 are substantially orthogonal with respect to each other when the container is in the formed configuration (e.g., FIGS. 1F and 2F). The container is configured to be held via the handle 104, 204 when the container is in the formed configuration (e.g., FIGS. 1F and 2F).

In an embodiment, the container is capable of maintaining the formed configuration (e.g., FIGS. 1F and 2F) once the container is moved from the box configuration (e.g., FIGS. 1E and 2E) to the formed configuration (e.g., FIGS. 1F and 2F). This is enabled by the structure of the container. The container on its own may maintain the formed configuration without using an added mechanism (e.g., mechanical interlock, fastening, etc.) and without using an external force.

In an embodiment, the separation panel 103, 203 extends beyond the first side panel 101, 201, beyond the second side panel 111, 211, or beyond both when the container is in the formed configuration (e.g., FIGS. 1F and 2F). For example, this may allow objects such as cups, beverages, bottles, etc. to be held and/or carried in the container.

In an embodiment, the separation panel 103, 203 is configured to compartmentalize a usable space of the container when the container is in the formed configuration (e.g., FIGS. 1F and 2F). For example, a compartmentalized container divided into multiple sections may allow multiple objects such as cups, beverages, bottles, etc. to be held and/or carried in the container.

In an embodiment, the container further comprises at least one end flap 115, 125, 215, 225 hingedly coupled to the first side panel 101, 201. The at least one end flap 115, 125, 215, 225 and the separation panel 103, 203 are substantially planar with respect to each other when the container is in the box configuration (e.g., FIGS. 1E and 2E). The at least one end flap 115, 125, 215, 225 and the separation panel 103, 203 are substantially orthogonal with respect to each other when the container is in the formed configuration (e.g., FIGS. 1F and 2F). For example, the end flaps 115, 125, 215, 225 may be used to secure objects such as cups, beverages, bottles, etc. and to prevent them from falling from the container. The end flaps 115, 125, 215, 225 may be hingedly coupled to end tabs 116, 126, 216, 226 (e.g., FIGS. 1A and 2A). The end tabs 116, 126 and a complementary side panel 121 may be joined or attached to each other (e.g., FIGS. 1E and 1F). Alternatively, the end tabs 216, 226 and the second side panel 211 may be joined or attached to each other (e.g., FIG. 2C). As another alternative variation, the at least one end flap may be hingedly coupled to the second side panel prior to folding a blank.

In an embodiment, the container is made from a blank 100, 200, 300*a*, 300*b*, 300*c*, 300*d*, 300*e*, 300*f*, 400*a*, 400*b*, 400*c*, 400*d*, 400*e*, 400*f*, 500*a*, 500*b* (e.g., FIGS. 1A, 2A, 3A-3F, 4A-4F, and 5A-5B).

In an embodiment, the first side panel 101, 201 is hingedly coupled to the bottom panel 107, 207 (e.g., FIGS. 1A and 2A).

In an embodiment, the second side panel 111, 211 is hingedly coupled to the bottom panel 107, 207 (e.g., FIGS. 1E and 2E). The coupling between the second side panel 111, 211 and the bottom panel 107, 207 may be achieved in various ways. For example, the second side panel 311 may be hingedly coupled to the bottom panel 307 prior to folding a blank (e.g., FIG. 3F). Alternatively, this coupling may be achieved using a complementary side panel 121, 321, which is hingedly coupled to the bottom panel 107, 307 (e.g., FIGS. 1A and 3E). The complementary side panel 121, 321 and the second side panel 111, 311 may be joined or attached to each other (e.g., FIGS. 1D and 1E). Furthermore, this coupling may be achieved using a base portion 220, which is hingedly coupled to the second side panel 211 (e.g., FIG. 2A). The base portion 220 and the bottom panel 207 may be joined or attached to each other (e.g., FIGS. 2B and 2E).

In an embodiment, the first side portion 502 comprises at least one additional hinge 551 to facilitate moving the container from the box configuration to the formed configuration (e.g., FIG. 5A). This may provide a better user experience when moving the container from the box configuration to the formed configuration.

In an embodiment, the second side portion 512 comprises at least one additional hinge 552 to facilitate moving the container from the box configuration to the formed configuration (e.g., FIG. 5A). This may provide a better user experience when moving the container from the box configuration to the formed configuration.

In an embodiment, the separation panel 503 further comprises at least one additional hinge 553 to facilitate moving the container from the box configuration to the formed configuration (e.g., FIG. 5A). This may provide a better user experience when moving the container from the box configuration to the formed configuration.

In an embodiment, the separation panel 203 is a first separation panel 203. The container further comprises a third side panel 221, a fourth side panel 231 and a second separation panel 213. The third side panel 221 is hingedly coupled to a third side portion 222. The fourth side panel 231 is hingedly coupled to a fourth side portion 232. The second separation panel 213 is hingedly coupled to the third side portion 222. The second separation panel 213 is hingedly coupled to the fourth side portion 232 (e.g., FIG. 2A).

In an embodiment, the first separation panel 203 and the second separation panel 213 are joined to each other (e.g., FIGS. 2D, 2E, and 2F). The first separation panel 203 and the second separation panel 213 may be joined or attached to each other using glue, adhesives, polymers, chemicals, etc.

In an embodiment, the fourth side panel 231 and the second side panel 211 are joined to each other (e.g., FIGS. 2D, 2E, and 2F; the fourth side panel 231 is not visible). The fourth side panel 231 and the second side panel 211 may be joined or attached to each other using glue, adhesives, polymers, chemicals, etc.

In an embodiment, the separation panel 503 is hingedly coupled to a partial separation panel 560 (e.g., FIG. 5B). The separation panel 503 and the partial separation panel 560 may be joined or attached to each other using glue, adhesives, polymers, chemicals, etc. The partial separation panel 560 may reinforce the separation panel 503.

With reference to FIGS. 1D-1F and 2D-2F, embodiments are directed to a container movable between a flat configuration (e.g., FIGS. 1D and 2D) and a box configuration (e.g., FIGS. 1E and 2E). The container comprises a first side panel 101, 201 hingedly coupled to a first side portion 102, 202, a second side panel 111, 211 hingedly coupled to a second side portion 112, 212, a separation panel 103, 203, and a bottom panel 107, 207. The separation panel 103, 203 is hingedly coupled to the first side portion 102, 202. The separation panel 103, 203 is hingedly coupled to the second side portion 112, 212. The bottom panel 107, 207 and the separation panel 103, 203 face each other when the container is in the box configuration (e.g., FIGS. 1E and 2E). The first side panel 101, 201 and the second side panel 111, 211 face each other when the container is in the box configuration (e.g., FIGS. 1E and 2E). The container is further movable between the box configuration (e.g., FIGS. 1E and 2E) and a formed configuration (e.g., FIGS. 1F and 2F). The first side panel 101, 201 and the second side panel 111, 211 face each other when the container is in the formed configuration (e.g., FIGS. 1F and 2F). The first side portion 102, 202 is configured to fold towards the first side panel 101, 201. The second side portion 112, 212 is configured to fold towards the second side panel 111, 211. The first side portion 102, 202 and the first side panel 101, 201 face each other when the container is in the formed configuration (e.g., FIGS. 1F and 2F; the first side portion 102, 202 is not visible). The second side portion 112, 212 and the second side panel 111, 211 face each other when the container is in the formed configuration (e.g., FIGS. 1F and 2F). The separation panel 103, 203 and the bottom panel 107, 207 are substantially orthogonal with respect to each other when the container is in the formed configuration (e.g., FIGS. 1F and 2F).

In an embodiment, the container is made from a blank 100, 200, 300*a*, 300*b*, 300*c*, 300*d*, 300*e*, 300*f*, 400*a*, 400*b*, 400*c*, 400*d*, 400*e*, 400*f*, 500*a*, 500*b* (e.g., FIGS. 1A, 2A, 3A-3F, 4A-4F, and 5A-5B).

Although embodiments are described above with reference to a container or a blank used to make the container, wherein the at least one end flap is shown hingedly coupled to the first side panel prior to folding the blank, the at least one end flap described in any of the above embodiments may alternatively be configured to be hingedly coupled to the second side panel prior to folding the blank. Such alternatives are considered to be within the spirit and scope of the present disclosure, and may therefore utilize the advantages of the configurations and embodiments described above.

In addition, although embodiments are described above with reference to a container, wherein the first side portion and the first side panel are shown hingedly coupled via a 45° hinge, the structure and design features of the first side portion, the first side panel, and the hinge coupling them described in any of the above embodiments may vary based on the desired objectives and applications. Portions or all of the container may be configured to accommodate such alternatives. Such alternatives are considered to be within the spirit and scope of the present disclosure, and may therefore utilize the advantages of the configurations and embodiments described above.

Further, although embodiments are described above with reference to a container, wherein the separation panel and the bottom panel are shown perpendicular with each other when the container is in the formed configuration, the angle between the separation panel and the bottom panel described in any of the above embodiments may vary. Portions or all of the container may be configured to accommodate such alternatives. Such alternatives are considered to be within the spirit and scope of the present disclosure, and may therefore utilize the advantages of the configurations and embodiments described above.

Yet further, although embodiments are described above with reference to a container, wherein the container is shown with uniform portions (e.g., with uniform thickness), portions or all of the container described in any of the above embodiments may alternatively be non-uniform (e.g., having varying thickness, discontinuities such as holes, slits, grooves, ridges, slits, a combination thereof, etc.). Such alternatives are considered to be within the spirit and scope of the present disclosure, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present disclosure.

The contemplated modifications and variations specifically mentioned in this disclosure are considered to be within the spirit and scope of the present disclosure.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

For the figures referred to herein, a summary of the reference numbers used in the figures is included in Table 1, below.

TABLE 1

| Reference Index for Drawings | | | | | |
|---|---|---|---|---|---|
| Description | FIGS. 1A-1F | FIGS. 2A-2F | FIGS. 3A-3F | FIGS. 4A-4F | FIGS. 5A-5B |
| Blank | 100 | 200 | 300a, 300b, 300c, 300d, 300e, 300f | 400a, 400b, 400c, 400d, 400e, 400f | 500a, 500b |
| First side panel | 101 | 201 | | | 501 |
| First side portion | 102 | 202 | | | 502 |
| Second side panel | 111 | 211 | 311 | 411 | 511 |
| Second side portion | 112 | 212 | | | 512 |
| Separation panel (first) | 103 | 203 | | | 503 |
| Handle | 104 | 204 | | | |
| Bottom panel | 107 | 207 | 307 | | 507 |
| End flap | 115, 125 | 215, 225 | | | |
| End tab | 116, 126 | 216, 226 | | | |
| Complementary side panel | 121 | | 321 | | |
| Base portion | | 220 | | | |
| Third side panel | | 221 | | | |
| Third side portion | | 222 | | | |
| Fourth side panel | | 231 | | | |
| Fourth side portion | | 232 | | | |
| Second separation panel | | 213 | | | |

TABLE 1-continued

| Reference Index for Drawings | | | | | |
|---|---|---|---|---|---|
| Description | FIGS. 1A-1F | FIGS. 2A-2F | FIGS. 3A-3F | FIGS. 4A-4F | FIGS. 5A-5B |
| Additional hinge | | | | | 551, 552, 553 |
| Partial separation panel | | | | | 560 |

Those skilled in the art will recognize or be able to ascertain using no more than routine experimentation, many equivalents to the specific embodiments of the disclosure described herein. Such equivalents are intended to be encompassed by the following claims.

What is claimed is:

1. A container movable between a flat configuration and a box configuration, the container comprising:

a first side panel, wherein the first side panel is hingedly coupled to a first side portion;

a second side panel, wherein the second side panel is hingedly coupled to a second side portion;

a separation panel, wherein the separation panel is hingedly coupled to the first side portion, wherein the separation panel is hingedly coupled to the second side portion, and wherein the separation panel comprises a handle;

a bottom panel, wherein the bottom panel and the separation panel face each other when the container is in the box configuration;

wherein the first side panel and the second side panel face each other when the container is in the box configuration;

wherein the container is further movable between the box configuration and a formed configuration;

wherein the first side portion is configured to fold towards the first side panel, wherein the second side portion is configured to fold towards the second side panel, wherein the first side portion and the first side panel face each other when the container is in the formed configuration, wherein the second side portion and the second side panel face each other when the container is in the formed configuration, wherein the separation panel and the bottom panel are substantially orthogonal with respect to each other when the container is in the formed configuration;

wherein the container is configured to be held via the handle when the container is in the formed configuration; and wherein the separation panel is configured to compartmentalize a usable space of the container when the container is in the formed configuration.

2. The container of claim 1, wherein the container is capable of maintaining the formed configuration once the container is moved from the box configuration to the formed configuration.

3. The container of claim 1, wherein the separation panel extends beyond the first side panel, beyond the second side panel, or beyond both when the container is in the formed configuration.

4. The container of claim 1, wherein the container further comprises at least one end flap, wherein the at least one end flap is hingedly coupled to the first side panel, wherein the at least one end flap and the separation panel are substantially planar with respect to each other when the container is in the box configuration, and wherein the at least one end flap and the separation panel are substantially orthogonal with respect to each other when the container is in the formed configuration.

5. The container of claim 1, wherein the container is made from a blank.

6. The container of claim 1, wherein the first side panel is hingedly coupled to the bottom panel.

7. The container of claim 1, wherein the second side panel is hingedly coupled to the bottom panel.

8. The container of claim 1, wherein the first side portion comprises at least one additional hinge to facilitate moving the container from the box configuration to the formed configuration.

9. The container of claim 1, wherein the second side portion comprises at least one additional hinge to facilitate moving the container from the box configuration to the formed configuration.

10. The container of claim 1, wherein the separation panel further comprises at least one additional hinge to facilitate moving the container from the box configuration to the formed configuration.

11. The container of claim 1, wherein the separation panel is a first separation panel, wherein the container further comprises a third side panel, a fourth side panel and a second separation panel, wherein the third side panel is hingedly coupled to a third side portion, wherein the fourth side panel is hingedly coupled to a fourth side portion, wherein the second separation panel is hingedly coupled to the third side portion, and wherein the second separation panel is hingedly coupled to the fourth side portion.

12. The container of claim 11, wherein the first separation panel and the second separation panel are joined to each other.

13. The container of claim 11, wherein the fourth side panel and the second side panel are joined to each other.

14. A container movable between a flat configuration and a box configuration, the container comprising:

a first side panel, wherein the first side panel is hingedly coupled to a first side portion;

a second side panel, wherein the second side panel is hingedly coupled to a second side portion;

a separation panel, wherein the separation panel is hingedly coupled to the first side portion, and wherein the separation panel is hingedly coupled to the second side portion;

a bottom panel, wherein the bottom panel and the separation panel face each other when the container is in the box configuration;

wherein the first side panel and the second side panel face each other when the container is in the box configuration;

wherein the container is further movable between the box configuration and a formed configuration;

wherein the first side portion is configured to fold towards the first side panel, wherein the second side portion is configured to fold towards the second side panel, wherein the first side portion and the first side panel face each other when the container is in the formed configuration, wherein the second side portion and the second side panel face each other when the container is in the formed configuration, wherein the separation panel and the bottom panel are substantially orthogonal with respect to each other when the container is in the formed configuration; and wherein the separation panel is configured to compartmentalize a usable space of the container when the container is in the formed configuration.

15. The container of claim 14, wherein the container is made from a blank.

* * * * *